US006065888A

United States Patent [19]

Maayeh

[11] Patent Number: 6,065,888

[45] Date of Patent: May 23, 2000

[54] HOT GLUE GUN HAVING ANNULAR LIQUID GLUE RETENTION CHAMBER

[75] Inventor: George Maayeh, Arlington, Tex.

[73] Assignee: Uniplast, Inc., Arlington, Tex.

[21] Appl. No.: 09/257,309

[22] Filed: Feb. 25, 1999

[51] Int. Cl.[7] ..... B67D 5/00

[52] U.S. Cl. ..... 401/1; 222/146.2; 222/146.5

[58] Field of Search ..... 401/1, 2, 3; 222/146.1, 222/146.2, 146.5

[56] References Cited

U.S. PATENT DOCUMENTS

| | | | |
|---|---|---|---|
| 3,960,296 | 6/1976 | Nord | 401/2 |
| 4,026,440 | 5/1977 | Crum et al. | 222/146.1 |
| 4,601,597 | 7/1986 | Bertram et al. | 401/1 |
| 4,951,846 | 8/1990 | Oster et al. | 222/146.5 |
| 5,026,188 | 6/1991 | Capodieci | 401/1 |
| 5,362,164 | 11/1994 | Wingert | 401/2 |

FOREIGN PATENT DOCUMENTS

| | | | |
|---|---|---|---|
| 67072 | 6/1948 | Denmark | 401/2 |

*Primary Examiner*—Charles R. Eloshway
*Attorney, Agent, or Firm*—Gregory M. Howison; Mark W. Handley

[57] ABSTRACT

A hot glue gun is provided with a heating chamber having an annular-shaped liquid glue retention chamber which is defined to extend between a wall of the heating chamber and the periphery of a solid glue stick feed region of the heating chamber. The annular shaped liquid glue retention chamber is sized such that during operation of the glue gun, not substantially less than ten percent (10%) of the volume of the chamber will contain melted glue which is disposed between the periphery of the solid glue stick feed region and the interior surface of the heating chamber. The rearward end of the heating chamber is sealed by a bushing having an inner surface with an interior diameter which is slightly smaller to approximately the same size as the exterior diameter of the periphery of the glue sticks, and thereby provides a seal for sealing liquid glue within the heating chamber. The bushing preferably has a periphery with an exterior diameter for adapting standard glue guns for use with glue sticks of slightly smaller sizes, such that the standard glue guns may be converted to have annular shaped liquid retention chambers disposed interiorly within the heating chambers thereof. A gripper housing adapter is also provided by a liner sleeve, for converting the gripper mechanisms of such standard glue guns for receiving the glue sticks of smaller nominal sizes than that for which they are designed.

14 Claims, 2 Drawing Sheets

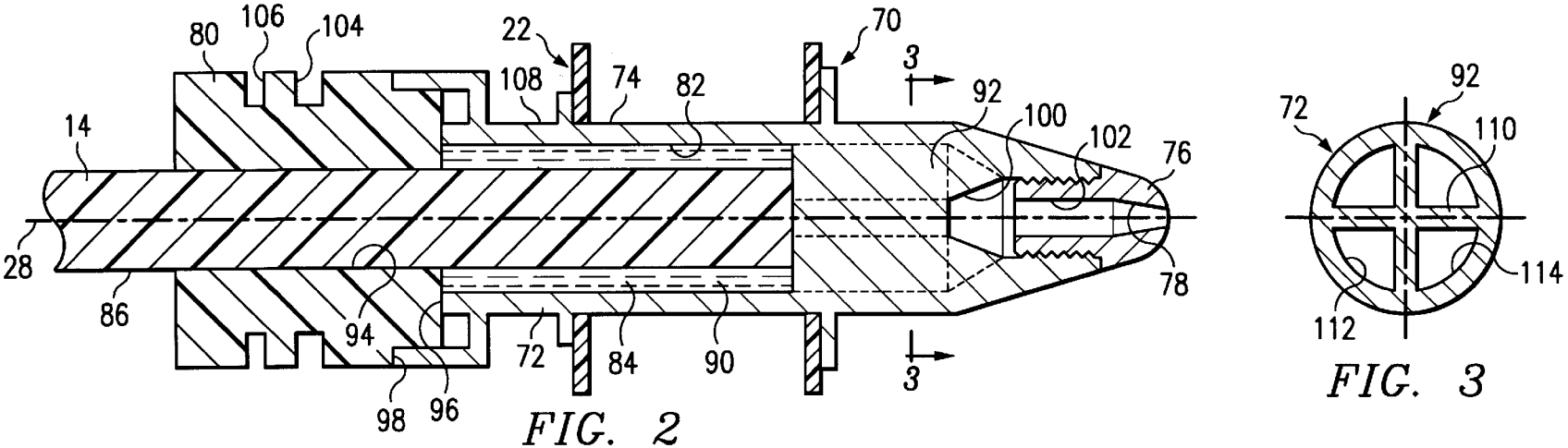
FIG. 3
FIG. 2
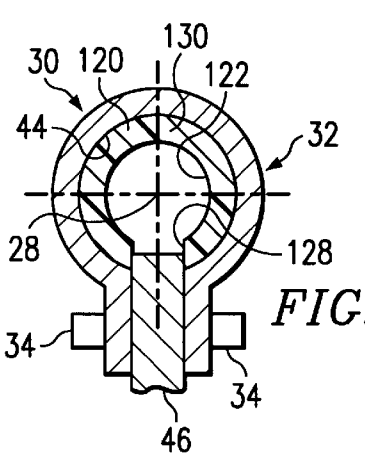
FIG. 5
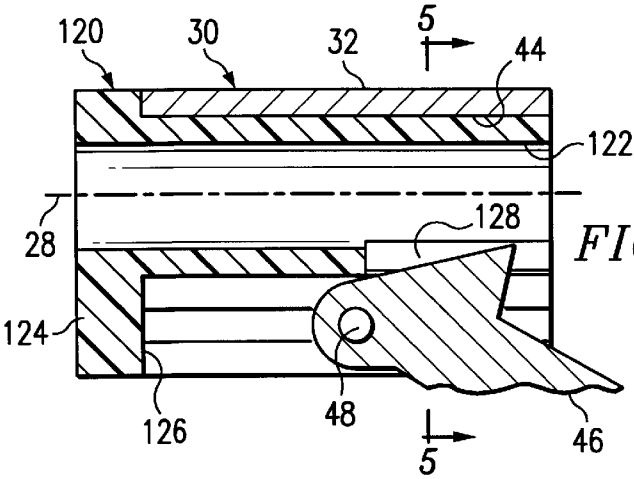
FIG. 4

HOT GLUE GUN HAVING ANNULAR LIQUID GLUE RETENTION CHAMBER

BACKGROUND OF THE INVENTION

Prior art hot melt glue guns have been provided for feeding hot melt glue sticks into heating chamber in which the glue sticks are heated to melt temperatures, and then the melted, liquid glues are selectively dispensed from the glue guns. The glue guns usually have trigger assemblies which include gripper mechanisms for gripping the glue sticks and feeding the glue sticks to the heating chambers. The heating chambers which are usually heated by electrical resistance heaters, or other types of heating means. The heating chambers are typically cylindrical in shape and sized to have internal diameters which are approximately the sizes of the outer diameters of respective ones of the glue sticks such that walls which define the surfaces of the heating chambers fit against the peripheries of the glue sticks. The interior surfaces of the heating chamber walls are heated to temperatures for melting the solid glue sticks to form liquid glue. Heat is transferred by contact of the surface of the heating chamber walls with the peripheries of the glue sticks.

During use, hot glue guns are typically operated at periodic intervals to dispense the melted glues as required for use in assembly, and other types of fabrication and manufacturing operations. However, during the short periodic intervals when the melted glues are typically dispensed, operators dispense the glues at rates which is determined by the thermal transfer rates for heat to transfer from the heating elements, through the heating chamber walls and to the glue sticks. The melted glues are usually dispensed through flow nozzles which have restricted openings, requiring that the glues are fully melted prior to passing through the openings and from the hot glue guns. Thus, the times for manufacturing operations requiring the dispensing of hot melt glues are often longer than are desirable and which would be achievable if the melted glues could be dispensed at a faster rates.

SUMMARY OF THE INVENTION

A hot glue gun is provided with a heating chamber having an annular-shaped liquid glue retention chamber which is defined to extend between a wall of the heating chamber and the periphery of a solid glue stick feed region of the heating chamber. The annular shaped liquid glue retention chamber is sized such that during operation of the glue gun, not substantially less than ten percent (10%) of the volume of the chamber will contain melted glue which is disposed between the periphery of the solid glue stick feed region and the interior surface of the heating chamber. The rearward end of the heating chamber is sealed by a bushing having an inner surface with an interior diameter which is slightly smaller to approximately the same size of the exterior diameter of the periphery of the glue sticks, and thereby provides a seal for sealing liquid glue within the heating chamber. The bushing preferably has periphery with an exterior diameter for adapting standard glue guns for use with glue sticks of slightly smaller sizes, such that the standard glue guns may be converted to have annular shaped liquid retention chambers disposed interiorly within the heating chambers thereof A gripper housing adapter is also provided by a liner sleeve, for converting the gripper mechanisms of standard glue guns for receiving the glue sticks of nominal sizes which are smaller than that for which such standard glue guns are designed.

BRIEF DESCRIPTION OF THE DRAWINGS

For a more complete understanding of the present invention and the advantages thereof, reference is now made to the following description taken in conjunction with the accompanying Drawings in which:

FIG. 2 illustrates a longitudinal, section view of the heating section of the hot glue gun;

FIG. 3 illustrates a sectional view of the heating section of the hot glue gun, taken along section line 3—3 of FIG. 2;

FIG. 4 illustrates a vertical, section view of a gripper mechanism of the hot glue gun; and FIG. 5 illustrates a sectional view of the gripper mechanism, taken along section line 5—5 of FIG. 4.

DETAILED DESCRIPTION OF THE INVENTION

Figure 1:
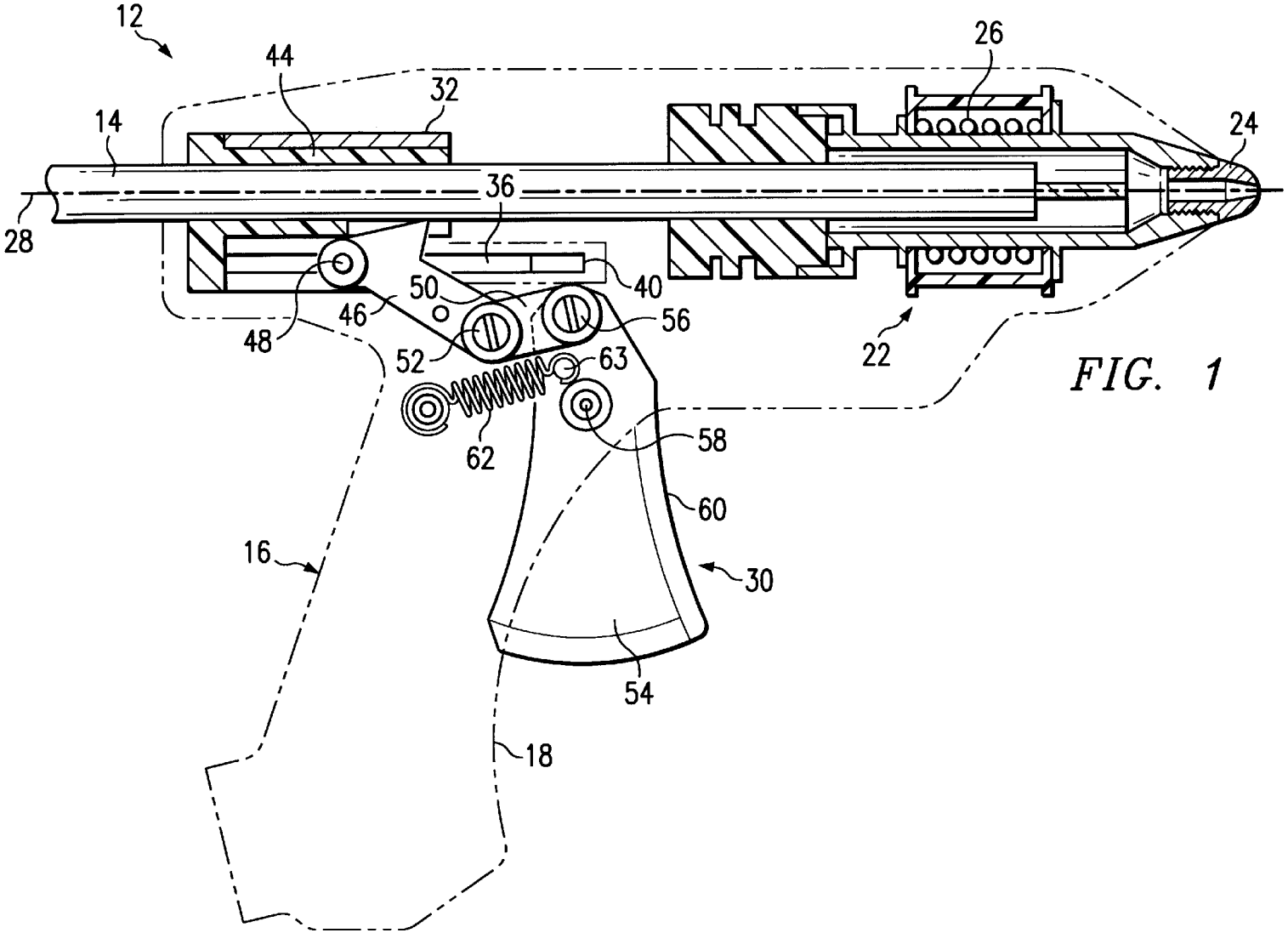
FIG. 1 illustrates a vertical, section view of the interior components of a hot melt glue gun made according to the present invention.

Referring now to FIG. 1, there is illustrated a vertical, section view illustrating the various internal components of a hot melt glue gun 12 for dispensing hot melt glue sticks 14. Preferably, the glue sticks 14 are in short, segmented lengths of approximately 10 inches, but the glue sticks 14 may also include continuous feed solid glue, such as that disposed on a reel, and the like. The glue gun 12 of the embodiment shown is preferably of a standard size for receiving and dispensing glue sticks which are three-quarters (¾) of an inch in nominal diameter, but has been modified for receiving and dispensing glue sticks 14 which are five-eighths (⅝) of an inch in nominal diameter. The glue gun 12 includes a housing 16 which provides an outer protective body for the glue gun 12, protecting operators from being burned by high temperatures of the interior heating components of the glue gun 12. The housing 16 includes a handle 18, and encloses a gripper section and a heater section 22. A dispensing nozzle 24 is threadingly secured to the heater section 22. A heating element 26 is included with the heater section 22, and preferably is provided by a resistive heating element. The glue gun 12 has a central, longitudinal axis 28 along which the glue sticks are fed into the heater section 22.

The hot melt glue gun 12 further has a feeder mechanism 30, which includes a gripper carriage 32 having linearly extending lugs 34. The lugs 34 have longitudinal lengths which extend forward and rearward for engaging within two slots 36 (one shown) of respective ones of two tracks 40 (one shown) for slidably securing the carriage 32 to the housing 16. The carriage 32 moves forward and rearwardly with respect to the housing 16, along a linear path defined by the two slots 36 (one shown) formed within the two tracks 40 (one shown) and preferably parallel to the longitudinal axis 28 of the glue gun 12. A gripper aperture 44 extends through the rearward portion of the carriage 32, coaxial with the longitudinal axis 28, for grippingly engaging the exterior of the glue stick 14 when the carriage 32 is moved forward with the glue stick 14 disposed therein. The gripper aperture 44 extends concentrically around the exterior of the glue stick 14, and is preferably coaxial with the longitudinal axis of the glue stick 14 and the longitudinal axis 28 of the glue gun 12. The carriage 32 is secured to a linkage 46 by a linearly floating pivot point 48. The linkage 46 is secured to a linkage 50 by a free-floating pivot point 52. A trigger piece 54 is pivotly secured to the linkage 50 by a free-floating pivot point 56. The trigger piece 54 is also pivotly secured to the housing 16 by the pivot shaft 58. The trigger piece 54 has a flat end surface 60 which is formed therein to provide an increased surface area for decreasing the pressure on a user's fingers when pushing the flat end surface 60 of the trigger piece 54 rearward into the handle 18. A spring 62 is secured from the trigger piece 54 to the trigger spring attachment point 63 for returning the trigger piece 54 to an initial position depicted in FIG. 1, after being pivoted around the pivot shaft 58 in response to pressure acting rearward on the flat end surface 60. In the preferred embodiment, the forward end of the linkage 40 moves upward to push the glue stick 14 into the top of the gripper aperture 44 when the trigger 54 is moved rearward and further into the handle 18, causing the glue stick 14 to be gripped within the aperture 44.

Referring now to FIG. 2, there is illustrated a vertically disposed section view of a heating unit 70 of the heater section 22. The heating unit 70 includes a chamber body 72. An exterior of the chamber body 72 is formed with recess 74 for receiving the heating element 26. The heating unit 70 further includes a flow nozzle 76 which is threadingly secured to the chamber body 72. The nozzle 76 includes an aperture 78 which provides a flow restriction for dispensing melted glue therethrough. The rearward end of the chamber heating unit 70 includes a bushing 80 which is secured to the rearward end of the chamber body 72. The bushing 80 is preferably formed of Teflon®. The chamber body 72 includes a heating chamber surface 82, which defines a heating chamber 84 interiorly therein. The glue stick 14 has a solid glue stick outer periphery of a size which, prior to heating, defines a glue stick feed region 86. The glue stick feed region outer periphery 86 has an effective diameter which is not substantially less than five percent (5%) smaller than the interior diameter of the heating chamber 84 to define an annular-shaped liquid glue retention chamber 90 and the effective cross sectional area of the heating chamber is not substantially less than ten percent (10%) greater than the effective cross sectional area of the solid glue feed region. The effective diameter is herein defined to be an approximate equivalent in terms of a diameter of a region having a circular profile or cylindrical shape, used to express the cross-sectional area for a region which may or may not have such a circular profile or cross-sectional shape, such those having cross-sections of oval shapes, multi-sided shapes, asymmetrical shapes, and other non-uniform shapes and the like The annular-shaped liquid glue retention chamber 90 extends from the rearward end of a centrally disposed heating dispenser member section 92 to the forward end of the bushing 80. The aperture 78 of the dispensing nozzle 24, the heating chamber surface 82, the heating chamber 84 and the annular-shaped liquid glue retention chamber 90 are preferably cylindrically shaped and coaxially disposed with the central, longitudinal axis 28 of the glue gun 12.

A passage for inserting the glue stick 14 interiorly through the bushing 80 is defined by an aperture 94. The aperture 94 is preferably cylindrical in shape, and has an effective interior diameter which is approximately the same as or slightly less than the effective diameter of the periphery of the glue stick 14 defining the solid glue feed region 86, such that melted liquid glue is sealed within the heating chamber 84, and in particular, the annular-shaped liquid glue retention chamber 90. The rearwardly disposed end of the chamber body 72 has two annular-shaped seal surfaces 96 and 98, which together provide a double, annular-shaped seal surfaces for sealing against the forward facing end of the bushing 80. The aperture 94 and the two seal surfaces 96 and 98 are preferably coaxial with the longitudinal axis 28 of the glue gun 12.

The heating chamber body 72 includes four flow ports 100 which are in fluid communication with the heating chamber 84 and the annular-shaped liquid glue retention chamber 90 for passing melted glue to the flow channel 102 and then into the aperture 78 of the nozzle 76. The exterior of the bushing 80 has recesses 104 and 106 formed therein, and the exterior of the chamber body 72 has a recess 108 formed therein, for securing the bushing 80 and the chamber body 72, respectively, of the heating unit 70 within the housing 16 (shown in FIG. 1) of the hot glue gun 12.

Referring now to FIG. 3 there is illustrated a sectional view of the centrally disposed heat dispenser member section 92 of the chamber body 72, taken along section line 3—3 of FIG. 2. The heat dispenser member section 92 includes a cross-shaped heating member 110 which extends within the heating chamber surface 82, and fits flush with the surface 82 to define four flow channels 112. The four flow channels 112 connect to the flow ports 100 (shown in FIG. 2). The cross-shaped heating member 110 aids in transferring heat to the forward end of the glue stick 14, such that it will melt when encountering the flat planar surfaces of the cross members 110 which extend perpendicular to the plane of section 3—3. The cross-shaped heating member 110 increases the thermal transfer surface area between the forward end of the melting glue stick 14 and the heating chamber body 72.

Referring now to FIG. 4, there is illustrated a vertical, section view depicting a portion of the feeder mechanism 30 of the hot melt glue gun 12. The feeder mechanism 30 includes the gripper carriage 32 having an interior gripper aperture 44, which preferably is sized to approximately the same size as the interior diameter of the heating chamber surface 82 of the chamber body 72. An adapter sleeve 120 has been inserted into the gripper aperture 44, and has an interior aperture 122 which preferably is sized to be slightly larger than that of the exterior periphery 86 of the glue stick 14. An annular section 124 is defined on the rearward end of the adapter sleeve 120, and has an annular forward facing shoulder 126 for engaging against the rearward end of the carriage 32. A slot 128 is defined on the lower portion of the adapter sleeve 120, and provides clearance for entry of the linkage 46 for passing into the interior of the aperture 122 to grip the glue stick 14 therein.

Referring now to FIG. 5, there is illustrated a sectional view of the feeder mechanism 30, taken along section line 5—5 of FIG. 4. The adapter sleeve 120, preferably formed of Teflon®, is shown interiorly disposed within and fitting flush against the gripper aperture 44 of the carriage 32. The slot 128 is aligned with the upper portion of the linkage 46. The two lugs 34 are disposed on opposite sides of the lowermost portion of the carriage 32. It should be noted that only the top central region 130 of the adapter sleeve 120, that which is opposite the slot 128, is required for fitting within the gripper aperture 44 of the carriage 32, across the aperture 44 from the linkage 46 which provides a gripper member for squeezing the glue stick 14 interiorly therein, for adapting the gripper carriage 32 for use with glue sticks which are the size of glue stick 14.

In operation, a glue gun 12 which is preferably of a standard size for receiving and dispensing glue sticks which are three-quarters (¾) of an inch in nominal diameter, has the bushing 80 is installed into the rearward end of the heating chamber body 72, sealing against the rearward end of the chamber body, and the liner sleeve 120 installed into the aperture 44 of the gripper carriage 32, to modify the glue gun 12 for receiving and dispensing glue sticks 14 which are preferably five-eighths (⅝) of an inch in nominal diameter.

A glue stick 14 is inserted into the rearward end of the housing 16 and into the gripper aperture 44 of the carriage 32, and then pushed forward and through the aperture 94 of the bushing 80 and into the heating chamber 84 of the heater section 22. The feed trigger 54 is pulled rearward and into the handle 18 of the housing 16, moving the linkages 46 and 50 to pull the carriage 32 forward in a linear direction, which causes the linkage 46 to pivot upwards and push the glue stick 14 upwards and into the upward surface of the gripper aperture 44 of the carriage 32, thereby gripping the glue stick 14 within the gripper aperture 44. With the glue stick 14 gripped within the gripper aperture 44, forward movement of the carriage 32 will push the glue stick 14 further into the aperture 94 of the bushing 80, and into the heating chamber 84. Release of the feed trigger 54, which is preferably biased into a forward position by the spring 62, will cause the feed trigger 54 to return to a forward position, causing the carriage 32 to move rearward within the slots 36 (one shown) of the tracks 40 (one shown), respectively. Rearward movement of the carriage 32 causes the linkage 46 to move downward, releasing the glue stick 14 to move downward and release from the upper portion of the gripper aperture 44. This leaves the glue stick 14 stationary, in a forwardly disposed position, as the gripper aperture 44 and the carriage 32 move rearward.

The feed trigger 54 is repeatedly moved between the rearwardly disposed and forwardly disposed positions to incrementally move the glue stick 14 forward into the heating chamber 84, which pushes melted glue out of the nozzle 76. The glue stick 14 will thus be fed into the heating chamber 84, with an annular-shaped liquid glue retention chamber 90 extending interiorly around the periphery 86 of the glue stick 14. As heat is transferred in the chamber body 72 to the glue stick 14, the glue stick 14 will melt until the annular-shaped liquid glue retention chamber 90 is filled with glue. Then, when the glue stick 14 is pushed further into the heating chamber 84, the forward end of the glue stick will soften and be deformed such that it expands into the annular shaped chamber section 90, which displaces the fully melted, liquid glue within the annular-shaped chamber 90 such that it flows through the flow channels 112, through the flow ports 100 and into the flow channel 102, and then through the aperture 78 of the flow nozzle 76 for dispensing from the hot glue gun 12 to increase the flow of melted glue through the flow nozzle 76 over that in which a glue retention chamber is not provided.

Although the preferred embodiment has been described in detail, it should be understood that various changes, substitutions and alterations can be made therein without departing from the spirit and scope of the invention as defined by the appended claims.

What is claimed is:

1. A hot melt glue gun for receiving solid glue, heating the solid glue to melt temperatures and dispensing the melted glue, said hot melt glue gun comprising:

a glue gun housing;

feed means for feeding a solid glue into said glue gun housing by way of a solid glue feed region defined by a periphery of the solid glue prior to heating the solid glue within said glue gun;

a heating chamber body having a wall which defines a heating chamber disposed interiorly within said heating chamber body, said heating chamber being disposed within said glue gun housing for receiving the solid glue from said feed means;

a heating element disposed within said glue gun housing and being disposed in relation to said heating chamber body for transferring heat to the solid glue within said heating chamber;

a bushing having seal surfaces which sealingly engage said heating chamber body and secure said bushing to a rearward portion of said heating chamber body, said bushing further having an aperture which is sized for receiving and sealingly engaging against the periphery of the solid glue; and a glue retention chamber defined between the wall of said heating chamber and said solid glue feed region, wherein said heating chamber has an effective interior diameter which is not substantially less than five percent (5%) greater than the diameter of said solid glue feed region, prior to heating the solid glue.

2. The glue gun of claim 1, wherein the cross-sectional area of said heating chamber is not substantially less than ten percent greater than the cross-sectional area of said solid glue as defined at said solid glue feed region.

3. The glue gun of claim 1, wherein said glue feed means includes a gripper aperture and an adapter sleeve for fitting within said gripper aperture, said adapter sleeve being sized for adapting said gripper aperture for operably receiving a glue stick of an exterior diameter which is not substantially less than five percent (5%) less than the exterior diameter of said gripper aperture.

4. The glue gun of claim 1, wherein said glue retention chamber is annular-shaped.

5. The glue gun of claim 4, wherein an interior surface of said wall which defines said heating chamber is cylindrical in shape.

6. The glue gun of claim 5, wherein said aperture of said bushing is cylindrical in shape.

7. A hot melt glue gun for receiving solid glue sticks, heating the glue sticks to melt temperatures and dispensing the melted glue, said hot melt glue gun comprising:

feed means for feeding glue sticks into said glue gun by way of a solid glue feed region defined by the periphery of said glue sticks prior to heating said glue sticks within said glue gun;

a heating chamber body having a wall which defines a heating chamber disposed interiorly within said heating chamber body, said heating chamber being disposed for receiving the glue sticks from said feed means;

a heating element disposed in relation to said heating chamber body for transferring heat to the glue sticks within said heating chamber;

a bushing having seal surfaces for sealingly engaging said heating chamber body, said bushing further having an aperture which is sized for receiving and sealingly engaging against the peripheries of the glue sticks; and a glue retention chamber defined between the wall of said heating chamber and said solid glue feed region, wherein said heating chamber has an effective interior diameter which is not substantially less than five percent (5%) greater than an effective diameter of said solid glue feed region, prior to heating the glue sticks.

8. The glue gun of claim 7, wherein the cross-sectional area of said heating chamber is not substantially less than ten percent greater than the cross-sectional area of said glue sticks as defined at said solid glue feed region.

9. The glue gun of claim 8, wherein said glue feed means includes a gripper aperture and an adapter sleeve for fitting within said gripper aperture, said adapter sleeve being sized for adapting said gripper aperture for operably receiving a glue stick of an exterior diameter which not substantially less than five percent (5%) less than the exterior diameter of said gripper aperture.

10. The glue gun of claim 9, wherein said glue retention chamber is annular-shaped.

11. The glue gun of claim 10, wherein an interior surface of said wall which defines said heating chamber is cylindrical in shape.

12. The glue gun of claim 11, wherein said aperture of said bushing is cylindrical in shape.

13. A hot melt glue gun for receiving solid glue, heating the glue sticks to melt temperatures and dispensing the melted glue, said hot melt glue gun comprising:

glue feed means for feeding cylindrical glue sticks having a first diameter into said glue gun by way of a solid glue feed region defined by the periphery of the glue sticks prior to heating the glue sticks within said glue gun;

a heating chamber body having a wall which defines a cylindrical heating chamber with a second diameter greater than said first diameter disposed interiorly within said heating chamber body, said heating chamber being disposed for receiving the glue stick from said glue feed means;

a heating element disposed in relation to said heating chamber body for transferring heat to the glue sticks within said heating chamber when disposed therein;

a bushing having a forward end with seal surfaces for sealingly engaging the heating chamber body, said bushing further having a cylindrical aperture which is sized to have a diameter substantially equal to said first diameter for receiving and sealingly engaging against the periphery of the glue sticks; and an annular-shaped glue retention chamber defined between the wall of said heating chamber and said solid glue feed region, wherein said heating chamber has an effective cross-sectional area which is not substantially less than ten percent greater than an effective cross-sectional area of said aperture of said bushing and not substantially less than ten percent greater than an effective cross-sectional area of said solid glue feed region, as defined by the diameter of the glue sticks prior to heating the glue sticks.

14. The glue gun of claim 13, wherein said glue feed means includes a gripper aperture and an adapter sleeve for fitting within said gripper aperture, said adapter sleeve being sized for adapting said gripper aperture for operably receiving a glue stick of an exterior diameter which not substantially less than five percent (5%) less than the exterior diameter of said gripper aperture.

* * * * *